United States Patent [19]

Clewes et al.

[11] 4,227,768

[45] Oct. 14, 1980

[54] MODULE FOR MOUNTING ELECTRICAL CONTACTS

[75] Inventors: Antony B. Clewes, Sherwood; Thomas W. Bowley, Bramcote, both of England

[73] Assignee: TRW Inc., Los Angeles, Calif.

[21] Appl. No.: 2,802

[22] Filed: Jan. 11, 1979

[30] Foreign Application Priority Data

Jan. 12, 1978 [GB] United Kingdom ..... 1298/78

[51] Int. Cl.[3] ..... H01R 9/10; H01R 9/22

[52] U.S. Cl. ..... 339/198 H

[58] Field of Search ..... 339/198 R, 198 P, 198 GA, 339/198 H

[56] References Cited

U.S. PATENT DOCUMENTS

| | | | |
|---|---|---|---|
| 3,253,252 | 5/1966 | Piperato et al. | 339/198 P |
| 3,993,395 | 11/1976 | Taylor | 339/198 H |
| 4,082,408 | 4/1978 | Angeus | 339/198 H X |

FOREIGN PATENT DOCUMENTS

| | | | |
|---|---|---|---|
| 590568 | 8/1977 | Switzerland | 339/198 H |

*Primary Examiner*—Howard N. Goldberg
*Assistant Examiner*—Eugene F. Desmond
*Attorney, Agent, or Firm*—Martin R. Horn

[57] ABSTRACT

A module for mounting electrical contacts comprises a base formed of resilient synthetic plastics material having means for mounting an electrical contact and a male and female coupling element disposed so that two modules can be connected to one another in end-to-end relation by means of the coupling element. The male and female coupling elements include an interlocking formation for retaining the male coupling element within the female coupling element. By means of the interlocking formation a series of modules can be firmly connected so that, in use, relative movement between interconnected modules is avoided.

5 Claims, 9 Drawing Figures

MODULE FOR MOUNTING ELECTRICAL CONTACTS

The present invention relates to a module for mounting electrical contacts.

U.K. Patent Specification No. 965,475 describes an electrical contact unit comprising a base formed of resilient synthetic plastics material and having an electrical contact mounted thereon. The unit is formed with male and female coupling elements so that a series of units may be coupled to one another in end to end relation to form an electrical contact strip. The electrical contact units are joined by shaping the male and female coupling elements to make interference fits with one another. It has been found that when these contact units are connected to form an electrical contact strip there is a tendency for them to move relative to one another.

It is an object of the present invention to provide a module for mounting electrical contacts which can be firmly connected to other modules so that, in use, relative movement between interconnected modules is avoided.

The present invention provides a module for mounting electrical contacts comprising a base formed of resilient synthetic plastics material having means for mounting an electrical contact and a male and female coupling element disposed so that two modules can be connected to one another in end to end relation by means of the coupling elements, the male and female coupling elements including an interlocking formation for retaining the male coupling element within the female coupling element.

Preferably the base is provided with a recess at one end shaped to form the female coupling element, the opposite end being provided with a projection to form the male coupling element. The projection may be shaped to form a pair of laterally-spaced ears and the recess shaped to receive the ears.

The interlocking formation may comprise a lug on the male coupling element which is located in a recess on the female coupling element. Preferably the lug in the male coupling element is a snap-fit with the recess on the female coupling element. The interlocking formation may also comprise a pin on the female coupling element which is held in a recess in the male coupling element.

To enable the invention to be fully understood, it will now be described, by way of example, with reference to the accompanying drawings in which:

FIG. 1 is a plan view of a module for mounting electrical contacts;

FIG. 2. is a section on the line AA of FIG. 1;

Figure 1:
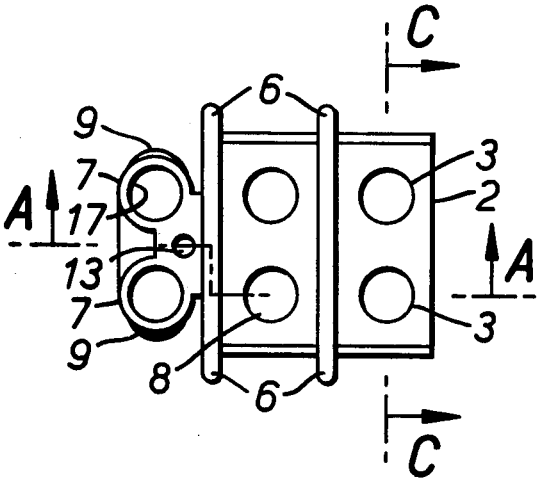
Figure 2:
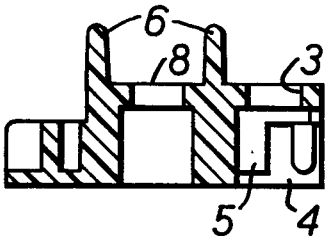
Figure 3:
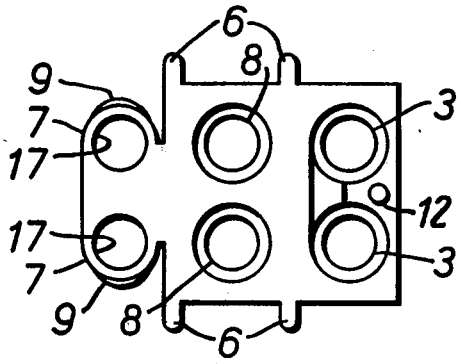
FIG. 3 is an underplan view.
Figure 4:
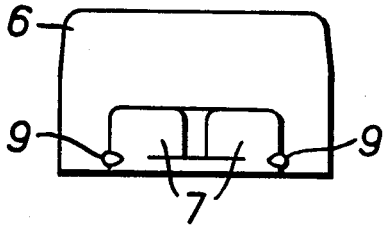
FIG. 4 is an end view looking from the left of FIG. 1.
Figure 5:
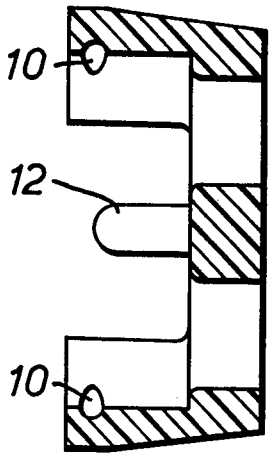
FIG. 5 is a section on the line CC of FIG. 1.

The module illustrated in FIGS. 1 to 7 includes a base 2 formed by a pair of apertures 3 leading to recess 4 which comprises the female coupling element of the module. A projection 5 extends over part of the rear wall of the recess 4. A male coupling element comprising a pair of laterally-spaced ears 7 extends from the end of the module opposite the female coupling element.

Between the male and female coupling elements the module is provided with a further pair of apertures 8 separated from the male and female coupling elements by tapered barrier walls 6.

The modules 1 are interconnected with one another to form a chain by inserting the ears 7 of the male coupling element by a sliding action into the recess 4 which forms the female coupling element of an adjacent module, the projection 5 being disposed in the recess 4 between the ears 7.

To prevent detachment of the interconnected modules during use the outer surface of each ear 7 on the male coupling element is provided with an arcuate lug 9 which, when the male coupling element is inserted into the female coupling element, snaps into and is retained in an arcuate recess 10 on the inside of the female coupling element. In addition a pin 12 projecting downwardly from the upper internal surface of the female coupling element is located as a sliding fit in a hole 13 disposed between the ears 7 of the male coupling element. These interlocking formations on the male and female coupling elements reduce the tendency of interconnected modules to move in the vertical plane when the modules are assembled.

Figure 6:
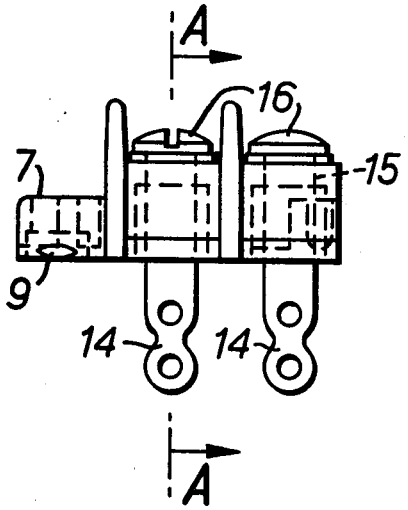
FIG. 6 is an elevation of the module showing an electrical contact mounted on the module.
Figure 7:
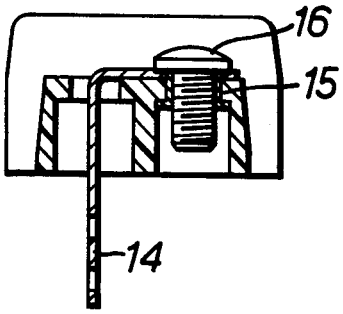
FIG. 7 is a section on the line AA of FIG. 6.

As shown in FIGS. 6 and 7 a metal contact plate 14 is mounted on the base of each module and secured by integral eyelets 15 which extend into the apertures 3. The eyelet 15 has a screw-threaded bore for receiving screws 16 for securing lead wires to the plate 14. The ears 7 of the male coupling elements have apertures 17 into which the lower ends of the screws 16 may extend. If desired separate eyelets may be used for securing the plate 14.

A chain of connected modules having a contact plate and screws assembled therein forms an electrical contact strip having a series of longitudinally spaced sets of contacts, each set being isolated from one another by the barrier walls 6. The modules are moulded from fibre reinforced flame retardant thermoplastic material.

Figure 8:
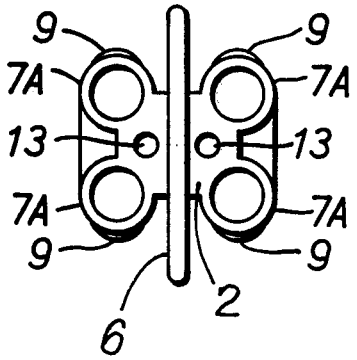
FIGS. 8 and 9 are plan views of alternative modules.

In assembling a series of modules it is sometimes necessary to be able to connect a pair of modules so that two female coupling elements are disposed adjacent one another. This can be done by means of a link module of the type illustrated in FIG. 8. As illustrated this module comprises a base 2 having a pair of ears 7A, forming a male coupling element at each side, separated by a barrier wall 6 and so arranged that each pair of ears 7A can be readily connected to the female coupling at the end of a series of connected modules.

Figure 9:
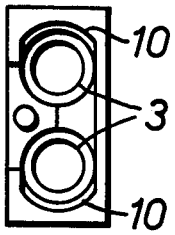

The link module can also be useed to provide an identical pair of fixing apertures at one end of a chain of modules to the pair of fixing apertures at the other end. This enables screws of the same size to be used at each end of the chain of modules to fix the chain to a chassis.

Where a series of connected modules terminates in a male coupling element a cover module in the form of a female coupling element can be mounted on the terminal male coupling element. Such a cover module is illustrated in FIG. 9. It can be seen that the link module includes the lugs 9 and hole 13 on a female coupling element and that the cover module includes the recesses 10 and pin 12 for co-operating with the corresponding lugs 9 and hole 13 on a male coupling element.

The apertures 3 of the cover module may be provided with screw-threaded eyelets, in the same manner as the module illustrated in FIGS. 1 to 7. Thus when a series of modules are assembled on a chassis a cover module can be mounted on the terminal male coupling element and, if desired, tapped metal inserts can be screwed through the chassis into the eyelets of the cover module.

The chain of interconnected modules will, by virtue of being made of resilient material, be capable of a small amount of relative movement such that a chain of modules could be made to assume a curved line to fit the particular curvature on a chassis with which the contact strip is to be used.

The modules may be coloured so that a chain or strip of interconnected modules may be formed of modules of different colours or a chain or strip may be formed of modules of the same colour; thus the modules of the chains or the whole chain could be coloured according to the circuit connections with which they are to be used, so that they will be readily identified.

The invention is not restricted to the details of the foregoing embodiments. For instance FIGS. 6 and 7 show the module used in connection with a screw 16 and solder-lug type contact plate 14. However it will be appreciated that the module can be used with other types of contact plates, for example a double-screw type contact plate or a screw and through-board tail type contact plate for printed circuit mounting.

Instead of a module having two pairs of apertures (2-way module) described with reference to the drawings, the module may have a single pair of apertures (1-way module) or three pairs of apertures (3-way module). It will be appreciated that the use of 2-way and 3-way modules reduces the number of separate modules in a chain of a given length. This decreases the possibility of relative movement between modules in the chain because there are fewer modules able to move.

The modules may be made in various sizes to accommodate different sizes of screws.

What I claim is:

1. An electrical terminal module for interlocking with other similar modules to form an extendable terminal block, comprising:

an electrically insulating, generally rectangular terminal member with a top and bottom opposite each other and with first and second sides opposite each other, said top having a plurality of connector openings, each said opening for retaining an electrical connector device therein;

first and second barrier member projecting from said top adjacent said sides;

a male coupling member disposed on said first terminal side and extending outwardly therefrom, said male coupling member having a pair of laterally spaced, projecting, ear-like members with an outwardly extending lug member disposed on each said ear-like member, said projecting, ear-like members and said lugs configured such that a second module can be joined thereto; and a female coupling member disposed on said second side and extending outwardly therefrom, said female coupling member having a base with a plurality of connector openings formed therein, a first recess configured to interfit with the projecting, ear-like members of a second module and a second recess configured to interfit with the lug member of a second module, whereby a series of modules can be joined together by interfitting the male and female coupling members together.

2. A module according to claim 1, further comprising:

a downwardly projecting pin element disposed on said female coupling member; and a recess formed in said male coupling member, and configured to engage the pin elements of a second module thereby reducing movement therebetween.

3. A module according to claim 1 wherein each said connector opening is threaded.

4. A module according to claim 1 wherein said terminal member, said male and female coupling members and said barrier members, are of unitary construction.

5. A module according to claim 1 wherein said members are molded from a fiber reinforced, flame retardant plastic.

* * * * *